United States Patent [19]

Helm

[11] 3,966,186

[45] June 29, 1976

[54] METHOD AND APPARATUS FOR FEEDING INSERTS SELECTIVELY

[75] Inventor: Herbert W. Helm, Hollidaysburg, Pa.

[73] Assignee: F. L. Smithe Machine Company, Inc., Duncansville, Pa.

[22] Filed: July 21, 1975

[21] Appl. No.: 597,530

Related U.S. Application Data

[63] Continuation-in-part of Ser. No. 194,819, Nov. 2, 1971, abandoned.

[52] U.S. Cl. ..... 270/58

[51] Int. Cl.[2] ..... B65H 39/04

[58] Field of Search ..... 270/54–58

[56] References Cited

UNITED STATES PATENTS

| | | | |
|---|---|---|---|
| 3,175,821 | 3/1965 | Gibson | 270/58 |
| 3,260,517 | 7/1966 | Sather | 270/58 |
| 3,484,100 | 12/1969 | Sather et al. | 270/58 |
| 3,570,870 | 3/1971 | Sather et al. | 270/58 |
| 3,606,728 | 9/1971 | Sather et al. | 270/58 X |

*Primary Examiner*—Edgar S. Burr
*Assistant Examiner*—A. Heinz
*Attorney, Agent, or Firm*—Stanley J. Price, Jr.; John M. Adams

[57] ABSTRACT

Apparatus is provided to feed selected inserts from a plurality of secondary feed stations onto a conveyor device in accordance with the requirements indicated on a primary insert. The primary insert is removed from a stack at a primary insert feed station by a suitable knife type card feeder and is transferred from the stack to a reading station. A reading device such as photoelectric cells or fluidic sensors read the indicia on the primary insert to determine what other inserts are to be included from secondary insert feed stations with the primary insert as the primary insert is inserted into an envelope or the like. Signals are simultaneously transmitted from the reading device through suitable circuitry to control devices for suckers or suction devices associated with each secondary insert feed station. The primary insert is then conveyed by a collating belt or chain that passes beneath the secondary insert feed stations to a discharge station. The secondary insert feed stations each include a stack of preselected secondary inserts and insert removal devices. The signals from the reading device control valve means associated with the suckers at each secondary feed station so that negative pressure is present at the sucker or suction device only when the reading device determines that a particular secondary insert is to be combined with the primary insert. Oscillating rolls at the secondary feed stations engage the inserts displaced by the suckers and transfer the inserts to a conveyor belt. The secondary inserts at the respective feed stations are conveyed in overlapped relation on the conveyor belts to pull-out segments adjacent the collating belt. The collating belt and secondary conveyor belts from the secondary insert feed stations are driven in timed relation and coordinated so that the particular secondary inserts from the secondary insert feed stations are deposited in overlying relation with the primary insert that provided the signals for feeding the particular secondary inserts.

10 Claims, 4 Drawing Figures

METHOD AND APPARATUS FOR FEEDING INSERTS SELECTIVELY

CROSS-REFERENCE TO RELATED APPLICATIONS

This application is a continuation in part of copending application Ser. No. 194,819 filed on Nov. 2, 1971 and entitled "Method And Apparatus For Feeding Inserts Selectively." and now abandoned.

BACKGROUND OF THE INVENTION

1. Field of the Invention

This invention relates to a method and apparatus for feeding inserts selectively onto a collating device and more particularly to a method and apparatus for selecting and feeding inserts by simultaneously selecting one or more secondary inserts and collating the inserts so selected.

2. Description of the Prior Art

Method and apparatus for collating a plurality of selected inserts and thereafter positioning the inserts in envelopes is known. The known methods and apparatus include a time delay device or a shift register. There is a need for a method and apparatus for collating a plurality of selected inserts that simultaneously select the inserts as indicated by a primary insert and provide a mechanical time delay for collating the respective secondary inserts with the primary insert.

SUMMARY OF THE INVENTION

This invention relates to a method and apparatus for feeding inserts selectively and includes a primary insert feed station. A primary insert is fed from the primary insert feed station to a reading station where suitable reading devices read the indicia on the primary insert and transmit signals to a plurality of secondary insert feed stations. The primary insert is then conveyed by a collating device past the respective secondary insert feed stations. The signal provided by the primary insert at the reading station actuates a suction type insert device to remove a secondary insert from a stack at the respective secondary insert feed station. Other apparatus position the insert on a secondary conveying device and the secondary insert is conveyed toward the collating device. The collating device and secondary conveying devices are so timed that the primary insert is located at the discharge portion of the respective secondary feed station when the respective secondary inserts arrive at the discharge portion and are transferred from the secondary conveying device to the collating device.

Accordingly, the principal object of this invention is to provide a method and apparatus for feeding inserts selectively in which there is a mechanical time delay between the selection of the secondary insert and the collating of the selected secondary insert with the primary insert.

Another object of this invention is to provide a method and apparatus for selectively feeding inserts in which the secondary inserts to be collated are simultaneously selected and fed to a collating device by signals transmitted by a primary insert that is removed from a stack at a primary insert station and transferred to the collating device.

These and other objects and advantages of this invention will be more completely disclosed and described in the following specification, the accompanying drawings and the appended claims.

DESCRIPTION OF THE PREFERRED EMBODIMENT

Figure 1:
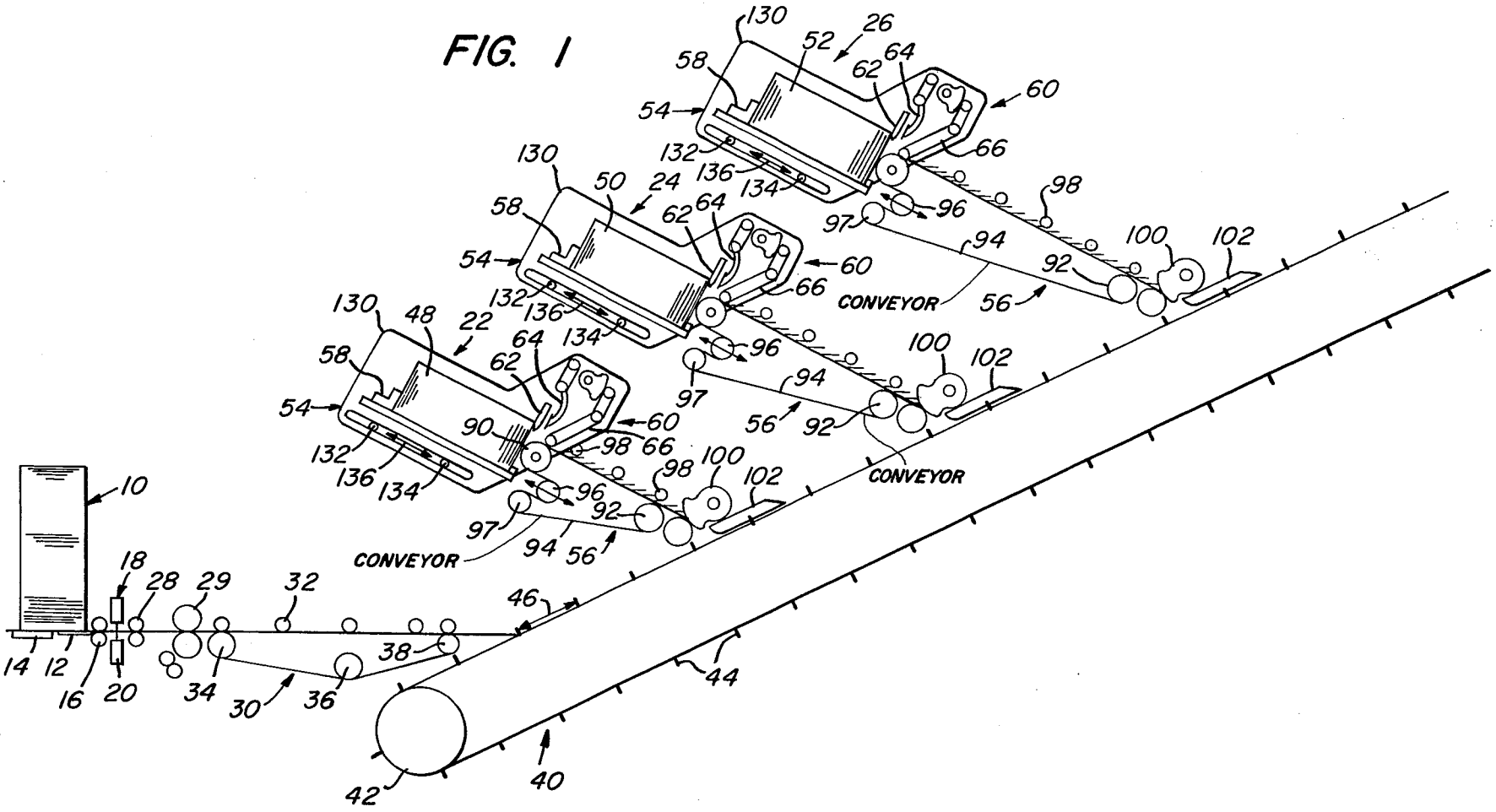
FIG. 1 is a schematic view of the apparatus for selectively feeding secondary inserts to a collating device in response to indicia on a primary insert.

Referring to the drawing and particularly FIG. 1, there is illustrated apparatus for feeding inserts selectively and includes a stack of primary inserts generally designated by the numeral 10. The primary inserts may be checks, bonds or the like that include indicia thereon such as apertures designating what other inserts are to be included with the primary insert as it is mailed to the intended recipient.

The lowermost primary insert, i.e., the insert on the bottom of the stack 10, designated by the numeral 12, is removed from the stack 10 by a knife type feeder 14 and transferred laterally from the stack 10 by a pair of gripper rolls 16. The lowermost primary insert 12 removed from the stack 10 is transferred by the gripper rolls 16 to a reading station generally designated by the numeral 18. The stack of primary inserts 10 with the knife type feeder 14 will be, for convenience, referred to as a primary insert feed station.

The reading station 18 has a reading or sensing device 20, such as a plurality of photoelectric cells or fluidic type sensors. The reading device 20 reads the indicia on the primary insert 12 and transmits a signal or signals to the respective secondary insert feed stations generally designated by the numerals 22, 24 and 26. It should be understood that although three secondary feed stations are illustrated, a greater or lesser number of feed stations may be provided without departing from the scope of the invention. The sending device 20 may be a plurality of photoelectric cells or fluidic sensors, with one sensor connected to each secondary feed station or a single sensing device that reads the indicia and simultaneously transmits signals to the respective secondary insert stations.

A second par of gripper rolls 28 engage and transfer the primary insert 12 from the reading station 18 to an endless conveyor belt 30. The primary insert 12 may, where desired, pass between the rolls of a printer generally designated by the numeral 29 prior to being positioned on the conveyor belt 30.

The conveyor belt 30 has an upper conveying reach with overlying rolls 32 that maintain the primary inserts on the conveyor belt 30 at preselected positions. The conveyor belt 30 includes end rolls 34 and 38 and an intermediate take up roll 36. The roll 38 is utilized to propel the endless conveyor belt 30 at a preselected speed as later discussed.

The primary insert 12 is conveyed by the endless conveyor belt to a collating chain or belt generally designated by the numeral 40, which will also be referred to as a collating device. The collating chain 40 is preferably an endless chain or belt reeved about end rolls 42 (only one of which is illustrated) and has transverse upwardly projecting pins 44 that form spacings 46 on the upper surface of the collating chain 40. The pins 44 are arranged to limit the movement of the primary insert 12 and the secondary inserts from the respective secondary stations so that the secondary inserts positioned in overlying relation with the primary insert are maintained in overlying relation to each other and within the spacing 46 formed by the pins 44. The collating chain 40 is driven at a preselected speed as later discussed so that the respective spacings 46 thereon are in underlying relation with the discharge portion of the secondary feed stations 22, 24 and 26 at preselected times.

The secondary insert feed stations 22, 24 and 26 are similar in construction and each includes a stack of different secondary inserts designated by the numeral 48, 50 and 52 at the respective secondary feed stations. The stack of secondary inserts at each feed station are supported on a support device 54 and are urged toward a secondary feed conveyor device generally designated by the numeral 56 by a slidable weight 58.

The secondary insert removal devices, including the secondary feed conveyor device and pull-out mechanism at the secondary feed stations 22, 24 and 26 are similar in construction and similar parts will be designated by similar numerals. The respective secondary feed stations are generally designated by the numeral 60 and include, as is schematically illustrated in FIG. 1, a knife type separator 62, a sucker or suction device 64 and oscillating rolls 66.

Figure 3:
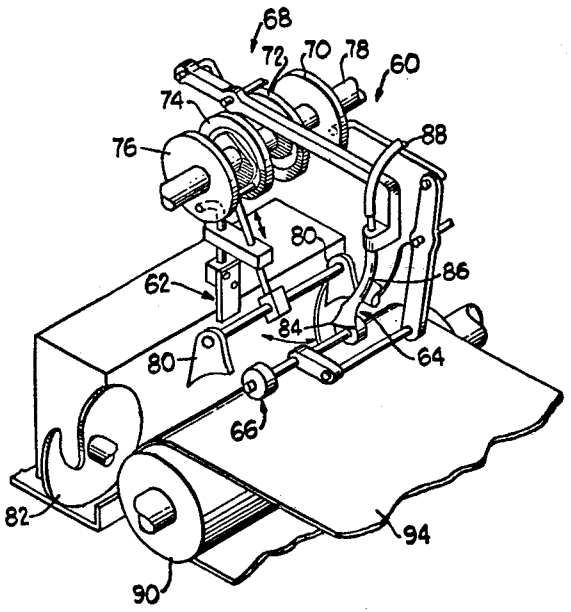
FIG. 3 is a perspective view of the apparatus for selectively removing secondary inserts from a stack at the respective secondary insert station.

The secondary insert removal apparatus 60 is illustrated in detail in FIG. 3 and includes a cam assembly generally designated by the numeral 68 with an oscillating roll cam 70, a sucker cam 72, a dagger cam 74 and a separator cam 76, all mounted on a common shaft 78. The respective cams 70, 72, 74 and 76 are arranged to move the knife separator 62, sucker or suction device 64, oscillating rolls 66 and dagger 80 in preselected timed relation to each other. The removal apparatus 60 also includes a pair of discs 82 that are arranged to maintain the bottom secondary insert separated from the stack after the separator knife 62 has moved the bottom insert away from the respective stack. The separator cam 76 moves the separator knife 62 vertically to the respective positions sequentially illustrated in FIG. 1 at the secondary feed stations 22, 24 and 26. The sucker cam 72 is arranged to move the wide mouth end portion 84 of the sucker arm 86 toward and away from the upper portion of the secondary insert on the bottom of the stack of secondary inserts. The sucker 64 has a flexible conduit 88 connected thereto that is, in turn, connected to a valve as later explained.

The secondary insert removal apparatus functions in the following manner. The knife type separator 62 separates the bottom insert from the stack as is illustrated at station 24 in FIG. 1 so that only a single insert is removed from the stack. The rotating discs rotate to maintain the single insert spaced from the stack of inserts. A sucker 64 is arranged to engage the bottom insert by means of a reduced pressure at the wide mouth opening 84 on the sucker arm 86 adjacent the top of the insert and bend the insert into engagement with the oscillating rolls generally designated by the numeral 66. The daggers 80 are arranged to hold down the insert until the oscillating rolls have engaged the insert on the conveying device 56. It will be apparent when there is an absence of reduced pressure at mouth 84 of the sucker 64, the bottommost secondary insert remains with the stack and is not removed therefrom.

The secondary feed conveyor device 56 has a pair of end rolls 90 and 92 with an endless flexible conveyor belt 94 reeved therearound. A take-up roll 96 and idler roll 97 maintain the desired tension on the conveyor belt 94 while it is driven by the end roll 92. A plurality of rollers 98 are positioned in overlying relation with the top strand of the conveyor belt 94 to maintain the secondary inserts thereon. The flexible conveyor belts 94 of the secondary feed conveyor devices 56 have different lengths so that the inserts travel different distances on the belts from the stack to the collating chain 40.

Figure 4:
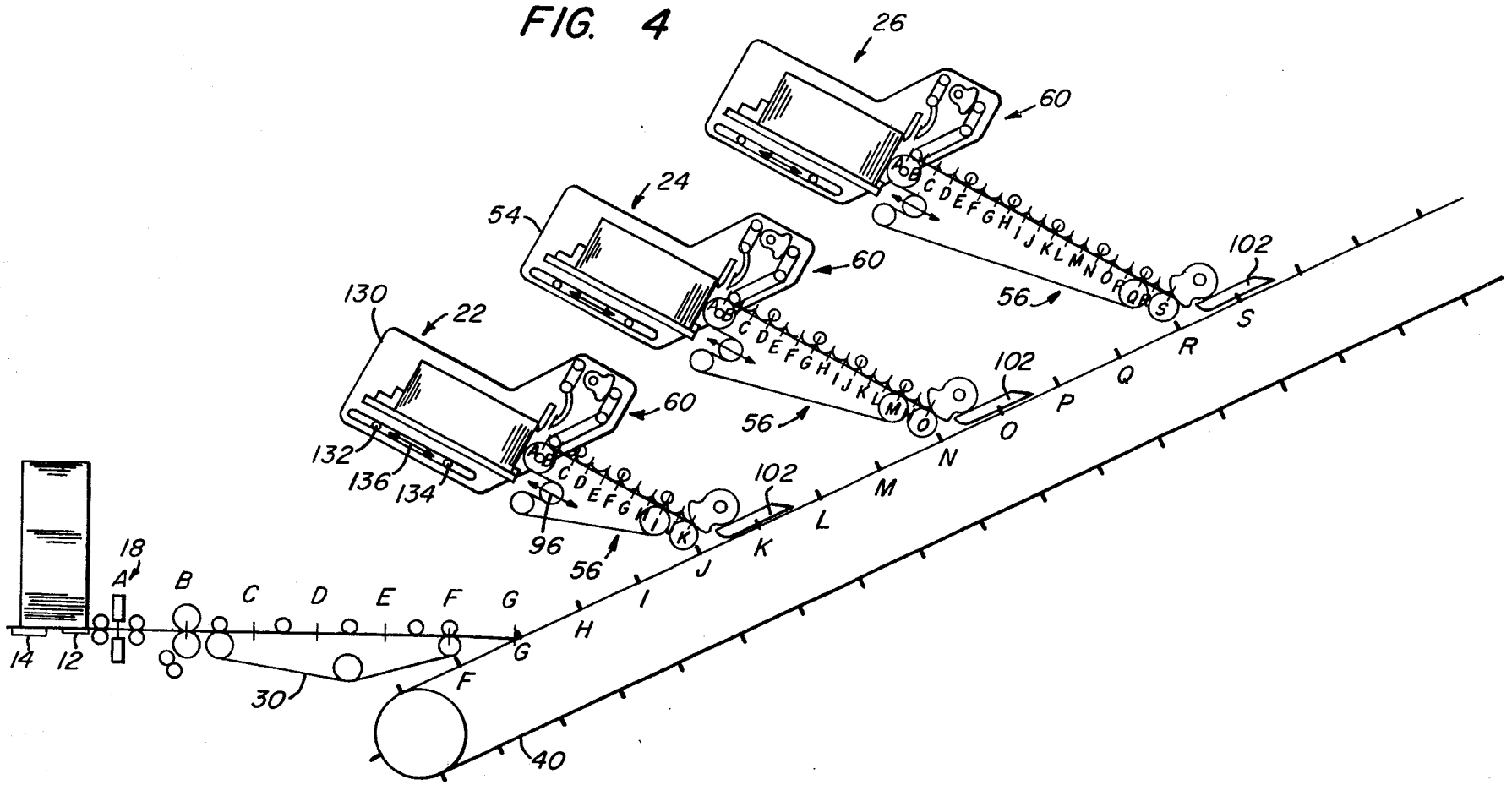
FIG. 4 is a schematic view similar to FIG. 1 illustrating the timing arrangement between the collator belt and the secondary feed station conveyor belt.

It is preferred that the speed of the collating chain 40 and the rate the primary insert is conveyed be such that the secondary inserts at feed stations 22, 24 and 26 are removed from the stack and positioned on the conveyor belt 94 in overlapped relation, as is illustrated in FIGS. 1 and 4. The overlap of the inserts should be approximately 1¼ inch. The overlapped inserts are conveyed on the conveyor belts 94 in timed relation with the collating chain 40 so that when the spacings 46 on the collating chain 40 containing the primary insert which provided the signal that a particular additional secondary insert should accompany the primary insert is beneath the particular conveyor belt 94, the pullout segment 100 removes the insert from the endless conveyor belt 94 and feeds the insert by means of a guide 102 onto the collator chain 40 and deposits the secondary insert within the spacings 46 with the primary insert responsible for providing the signal to remove the particular secondary insert.

Thus, when the primary inserts provide a signal or signals to the suckers 64 at the respective secondary feed insert stations 22, 24 and 26, depending on the signals transmitted one or more secondary inserts are similarly removed from the respective stacks and positioned on the endless conveyor belt 94 associated therewith while the primary insert is being conveyed by the collating chain 40. As the primary insert on the collating chain 40 reaches a postion underlying the preselected secondary feed station pull-out rolls, the preselected secondary insert is removed by the pull-out rolls 100 and deposited in overlying relation with the primary insert. Where there is an absence of a signal to the particular station as the primary insert passes beneath the station, the pull-out rolls do not remove a secondary insert at that station because the sucker 64 did not remove an insert from the bottom of the stack of secondary inserts at the time the primary insert was being read by the reading device 20.

Figure 2:
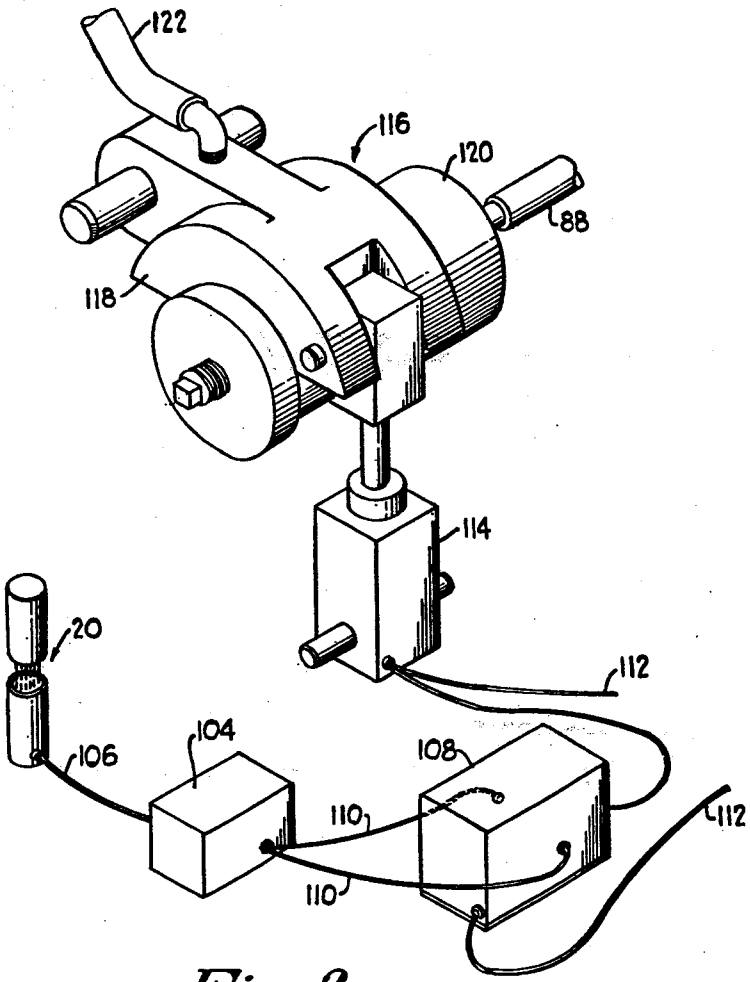
FIG. 2 is a schematic and perspective illustration of the apparatus and cricuit for transmitting signals from the reading device to the secondary insert removal apparatus at the respective secondary insert feed station.

The circuitry for providing reduced pressure for the sucker 64 at the respective feed station is illustrated in FIG. 2 and includes an amplifier 104 connected to the reading device 20 by conduit 106. The amplifier, in turn, is connected to a relay 108 that is actuated by the reading device 20 through conductor 110. Current is supplied through circuit 112 to the relay 108 and the valve actuator 114. The control valve generally designated by the numeral 116 has a stator portion 118 and a rotor portion 120. A tubular conduit or pipe 122 is connected to the stator porton 118 and to the vacuum pump. The rotor portion is connected to the tubular conduit 88 that is connected to suction arm 86 of sucker 64. With this arrangement, the vavle mechanism 116 provides a negative pressure at the wide mouth opening 84 of sucker 64. The signal provided by reading device 20 is transmitted through amplifier 104 to relay 108 which, in turn, actuates the valve actuator 114 and opens valve 116 to provide a negative pressure or suction through conduit 88 to the sucker 64. With the negative pressure applied to the opening 84 of sucker 64, the rotation of the cam assembly 68 about the shaft 78 permits the sucker 64 to engage and feed the insert from the bottom of the stack to the oscillator rolls 66. When there is an absence of vacuum because of an absence of a signal from reading device 20, the bottom insert is not engaged by the sucker 64 and remains with the stack. The overlapped secondary inserts on the conveyor belt 94 have a space between the inserts for the absent insert so that the pull-out rolls will not engage and pull out a secondary insert when the primary insert passes therebeneath.

Although the appratus illustrated in FIG. 3 for removing the insert and the apparatus for providing the signal to actuate the sucker illustrated in FIG. 2 have been described, it should be understood that other suitable separating devices and actuating devices may be employed to remove a bottom insert from the stack of secondary inserts at the respective feed stations and deposit the bottom inserts on a suitable device. It is essential, however, that the insert removing apparatus include an element that is actuated by a signal from the reading device 20. As previously stated a reading device 20 may be provided for each secondary insert station and so positioned at the reading station 18 that all of the reading devices 20 transmit signals substantially simultaneously to the respective secondary insert stations.

Referring to FIG. 4 there is illustrated the basic timing layout for the respective conveyor belts 56 and the combination of conveyor belt 30 and the collating chain 40. The timing of the belts and chain are such that the secondary inserts from the respective secondary insert feed stations is deposited on the collating chain in overlying relation with the primary insert responsible for the signal to deposit the particular insert. An incremental distance traveled by each of the conveyor belts per time unit is illustrated by the distance between the alphabetical designations in FIG. 4. For example the primary insert travels from the reading station 18 to the printer 29 in one unit of time. This distance is designated as the distance between letters A and B. Similarly, in the next unit of time the insert travels a distance from B to C on the conveyor 30 and in the next unit of time travels a distance of from C to D on conveyor belt 30. As illustrated six units of time between A and G are required to convey the primary insert from the reading station 18 to the collating belt 40 and ten units of time between A and K are required to convey the primary insert to a location beneath the guide 102 of the first insert station 22.

The conveyor belt 56 associated with the first insert station 22 is traveling at a speed so that ten units of time are required to convey the insert from the stack to the collating chain 40. The incremental distances are designated by the letters A – K on conveyor belt 56 associated with the first insert station 22.

The conveyor belt 56 associated with the second insert station 24 is traveling at the same speed as conveyor belt 56 associated with the first insert station 22. The conveyor belt 56 at insert station 24 is, however longer and requires 14 units of time between A - O to convey a secondary insert from the stack of the guide 102 and deposit the secondary insert on the collating chain 40. The collating chain 40 is traveling at a fixed speed so that 14 units of time designated by the letters A - O are required to convey the primary insert from the reading station 18 to a position beneath the guide 102 of insert station 24.

The conveyor belt 56 associated with the third insert station 26 has a conveying reach longer than the conveying reach of the conveyor belt associated with secondary insert stations 22 and 24 so that it takes 18 units of time between A - S for the secondary insert to be conveyed from the stack to the guide 102 above the collating chain 40 and the same time A - S for the primary insert to be conveyed from the reading station 18 to a location beneath guide 102 at the third station 26.

The support device 54 at each of the secondary insert stations 22, 24, 26 has a frame 130 adjustably mounted on rollers 132 and 134. The frame 130 may be adjusted toward and away from the collating chain 40 as indicated by the arrows 136 to provide a fine adjustment in length of the respective convayor belts. The frame 130 is suitably connected with the take-up roller 96 to provide the fine adjustment and maintain the desired tension on the conveyor belt 56.

With this arrangement the conveyor belts 56 of the secondary insert stations 22 – 26 move at the same speed and the time required to convey the secondary insert from the stack to the guide 102 above the collating chain 40 is dependent upon the length of the conveyor belt. Thus when signals are simultaneously transmitted from the reading device 18 to the secondary insert stations 22 – 26, the signals actuate the feeding device at the respective stations to remove insert removal apparatus 60 to remove an insert at the respective secondary insert stations and deposit the insert on the respective conveyor belt. The time required to convey the insert from the stack to the guide 102 above the collator chain 40 is dependent upon the length of the distance traveled by the insert on the respective conveyor belt. Thus as a signal is transmitted simultaneously to each of the secondary insert stations 22 – ≈the inserts are simultaneously removed at all three stations and deposited on the endless conveyor belts associated therewith. The time required, however, to convey the inserts from the respective stations to the collating chain 40 is such that the primary insert on the collating chain 40 is in underlying relation with the respective guide 102 for the respective secondary insert station. The drive pulleys for the conveyors 30 and 56 and the collating chain 40 are preferably suitably connected to each other through mechanical shafts and gears so that all of the conveying devices are maintained in timed relation to each other and provide the above described timing arrangement therebetween.

It will thus be apparent from the above that the inserts are simultaneously removed at the secondary insert stations and conveyed by means of the conveyor belts to the collating chain 40 where the secondary inserts are positioned in overlying relation with the primary insert responsible for transmitting the signals to the secondary insert stations 22 – 26.

With the description of the above apparatus, it will be apparent that it is now possible, by reading the indicia on a primary insert at a primary feed station, to simultaneously remove secondary inserts at a selected one or more of the secondary insert stations and to feed both the primary insert and selected secondary inserts to a collating device in timed relation so that the secondary inserts are positioned in overlying relation with the primary insert to which they are associated as the primary insert is conveyed to a discharge station.

It will also be apparent that the secondary insert stations may contain inserts in other arrangements than the stacks illustrated in FIG. 1. For example, the secondary insert stations could feed inserts from a preprinted roll or print on a web at the secondary insert station and then cut off separate inserts. The separate severed inserts could be fed to the collating device in the overlapped relation shown. Apparatus similar to the rotary valve with the solenoid lifter could be used to selectively feed the web to a suitable cut off device.

According to the provisions of the patent statutes, I have explained the principle, preferred construction and mode of operation of my invention and have illustrated and described what I now consider to represent its best embodiments. However, I desire to have it understood that, within the scope of the appended claims, the invention may be practiced otherwise than as specifically illustrated and described.

I claim:

1. Apparatus for selectively collating inserts comprising, means to move a primary insert from a stack of primary inserts at a primary insert feed station, a reading device operable to read indicia on primary inserts, first conveying means to convey primary inserts from said primary insert feed station across said reading device to a discharge station, a plurality of secondary insert feed stations positioned adjacent to said first conveying means between said reading device and said discharge station, separate means to remove a secondary insert from a source of secondary inserts at said plurality of secondary insert feed stations, a plurality of second conveying means to separately transfer secondary inserts removed from said respective source of secondary inserts at each of said secondary insert feed stations to said first conveying means, and signal transmitting means responsive to signals provided by said reading device to simultaneously actuate said means that remove a secondary insert from each source of secondary inserts at each of said secondary insert feed stations.

2. Apparatus for selectively collating inserts as set forth in claim 1 in which said means to remove a secondary insert from a source of secondary inserts includes, suction means movable toward and away from said source of inserts and operable to engage one of said secondary inserts in response to a signal from said signal transmitting means.

3. Apparatus for selectively collating inserts as set forth in claim 2 which includes, valve means to provide a negative pressure at an opening in said suction means, said valve means responsive to said signal means.

4. Apparatus for selectively collating inserts as set forth in claim 2 in which said means to remove a secondary insert includes, pull-out rolls movable toward and away from said source of inserts and operable to engage and transfer said secondary insert engaged by said suction means.

5. A method for selectively collating inserts comprising, removing a primary insert from a stack of primary inserts at a primary insert feed station, conveying said primary insert from said primary insert feed station to a reading station, reading indicia on said primary insert at said reading station with a reading device, transmitting signals through a signal transmitting device to a plurality of separate secondary insert removing devices at a plurality of secondary insert feed stations, said signals generated by said reading device being responsive to indicia on said primary insert, thereafter conveying said primary insert on a moving collating device from said reading station to a discharge station, said signal transmitted from said signal transmitting device simultaneously actuating said plurality of separate secondary insert removal devices at said secondary insert feed station in response to said signals to simultaneously remove secondary inserts from a plurality of sources of secondary inserts as said primary insert is positioned on said collating device, and conveying said secondary insert removed from said source of secondary inserts toward said moving collating device in timed relation thereto as said primary insert is being conveyed on said moving collating device so that said secondary inserts are deposited on said moving collating device in overlying relation with said primary insert containing indicia thereon for removal of said secondary inserts from the stack of secondary inserts.

6. A method for selectively collating inserts as set forth in claim 5 which includes, actuating said secondary insert removal apparatus at substantially the same time as said indicia on said insert is read by said reading device.

7. A method for selectively collating inserts as set forth in claim 5 which includes, positioning said primary insert on a movable collating device after said reading device reads the indicia thereon and maintaining said primary insert spaced from other primary inserts, and positioning said secondary inserts in overlying relation with said primary insert as said primary insert passes said secondary insert feed station.

8. A method for selectively collating inserts as set forth in claim 5 which includes, conveying a plurality of secondary inserts on an endless conveyor belt from said secondary insert feed station toward a movable collating device that is conveying spaced primary inserts thereon, said plurality of secondary inserts positioned in overlapped relation on said endless conveyor belt.

9. A method of selectively collating inserts as set forth in claim 5 which includes, a plurality of spaced secondary insert feed stations positioned adjacent to a movable collating device arranged to convey said primary inserts from said reading station, transmitting separate signals from said signal transmitting device at substantially the same time to said plurality of spaced secondary insert feed stations.

10. A method for selectively collating inserts as set forth in claim 5 which includes, continuously removing primary inserts from said stack of primary inserts at said primary insert feed station, conveying said primary inserts in spaced tandem relation to said reading station, sequentially reading the indicia on said spaced primary inserts at said reading station, transmitting separate signals through a signal transmitting device to secondary insert removing apparatus at a plurality of secondary insert feed stations, said separate signals generated by said reading device being responsive to indicia on said primary inserts, conveying said primary inserts in spaced relation on a moving collating device from said reading station to a discharge station, simultaneously actuating said secondary insert removal apparatus at said plurality of secondary insert feed stations in response to signals to remove selected secondary inserts from one or more of said plurality of stacks of secondary inserts, conveying said secondary inserts removed from said stacks toward said moving collating device in timed relation thereto so that a plurality of said secondary inserts are deposited on said collating device in overlying relation with the primary insert containing indicia thereon for removal of said plurality of secondary inserts deposited thereon.

* * * * *